US005601621A

United States Patent [19]

Schrell et al.

[11] Patent Number: 5,601,621

[45] Date of Patent: Feb. 11, 1997

[54] PROCESS FOR THE PRODUCTION OF A FIBER MATERIAL AND PROCESS FOR THE DYEING OF THE MODIFIED FIBER MATERIAL WITH ANIONIC TEXTILE DYES

[75] Inventors: Andreas Schrell, Frankfurt am Main; Werner H. Russ, Flörsheim/Main; Thomas Riehm, Hattersheim am Main, all of Germany

[73] Assignee: Hoechst Aktiengesellschaft, Germany

[21] Appl. No.: 387,368

[22] Filed: Feb. 13, 1995

Related U.S. Application Data

[63] Continuation of Ser. No. 96,506, Jul. 22, 1993, abandoned.

[30] Foreign Application Priority Data

Jul. 24, 1992 [DE] Germany ..... 42 24 441.2

[51] Int. Cl.[6] ..... D06P 1/38; D06P 3/872; D06M 13/10; D06M 13/402

[52] U.S. Cl. ..... 18/493; 8/532; 8/543; 8/564; 8/565; 8/572; 8/576; 8/115.51; 8/115.7; 8/189.194; 8/930

[58] Field of Search ..... 8/493, 565, 570, 8/576, 189, 658, 532, 543, 188, 930, 564, 572, 115.51, 115.7, 194

[56] References Cited

U.S. PATENT DOCUMENTS

| | | | |
|---|---|---|---|
| 3,313,589 | 5/1967 | Landaver et al. | 8/576 |
| 3,431,271 | 3/1969 | van Loo et al. | 8/189 |
| 3,567,501 | 3/1971 | Ward et al. | 117/139.5 |
| 3,651,139 | 3/1972 | Feinaver et al. | 8/189 |
| 3,963,433 | 6/1976 | Ward et al. | 8/120 |
| 3,963,434 | 6/1976 | Ward et al. | 8/120 |
| 4,236,012 | 11/1980 | Fujimoto et al. | 548/229 |
| 4,284,410 | 8/1981 | Nischwitz et al. | 8/471 |
| 4,331,442 | 5/1982 | Uhlig et al. | 8/565 |
| 4,462,865 | 7/1984 | Walles | 8/189 |
| 4,612,015 | 9/1986 | Dyllick-Brenzinger | 8/576 |
| 4,654,043 | 3/1987 | Streit et al. | 8/189 |

FOREIGN PATENT DOCUMENTS

| | | |
|---|---|---|
| 1463682 | 2/1977 | England . |
| 0009199 | 2/1980 | European Pat. Off. . |
| 2226504 | 11/1974 | France . |
| 972000 | 10/1964 | United Kingdom . |

OTHER PUBLICATIONS

Hoechst, Textiles, Dyeing, Paper, Cellulose–p. 1, 655185, Dyebatk Additives, Mar. 11, 1964.

Band E4, Kohlensäure–Derivate, Hermann Hagemann, 1983, pp. 192–194.

Journal of Applied Polymer Science, May 1977, vol. 21, No. 5, pp. 1933–1944.

*Primary Examiner*—Margaret Einsmann
*Assistant Examiner*—Caroline L. Dusheck
*Attorney, Agent, or Firm*—Connolly & Hutz

[57] ABSTRACT

Fiber materials can be modified by applying heterocycloaliphatic compounds containing at least one primary, secondary or tertiary amino group or quaternary ammonium group, the hetero portion of which in the ring is a carbonic ester radical of the formula —O—CO—O— or a carbamic acid radical of the formula —O—CO—NH—, in aqueous alkaline solution by exposing the fiber material to these compounds at a temperature of between 60° and 230° C. The characteristic of the modified fiber material is that it can be dyed with dye solutions of water-soluble, anionic textile dyes which are low in electrolytes or entirely free of electrolytes and/or are low in alkali or entirely free of alkali. The advantage of a dyeing process carried out in this manner, in particular for fiber-reactive dyes, is that fixation of the dyes under alkaline conditions is unnecessary.

5 Claims, No Drawings

PROCESS FOR THE PRODUCTION OF A FIBER MATERIAL AND PROCESS FOR THE DYEING OF THE MODIFIED FIBER MATERIAL WITH ANIONIC TEXTILE DYES

This application is a continuation of U.S. application Ser. No. 08/096,506 filed Jul. 22, 1993, now abandoned.

DESCRIPTION

Process for the production of a fiber material and process for the dyeing of the modified fiber material with anionic textile dyes.

Textile materials, such as woven fabrics, knitted fabrics or yarns, containing cellulose fibers can be dyed with anionic dyes by known methods. All methods have in common that alkali is necessary for fixing the dye on the fiber, in particular when dyeing with reactive dyes, and salts must be added for achieving acceptable color depths. In particular in the case of dyeing with fiber-reactive dyes, inactive dye hydrolysis products pass additionally into the salt-containing dye liquors, which are formed in the course of the dyeing process in the strongly alkaline dye solution. Accordingly, the fixation process remains incomplete, and hydrolyzation products accumulate in the waste water of the dyeing process, coloring it accordingly. For the reasons mentioned above, dyeings obtained by customary methods must be subjected to expensive washing operations to remove, on the one hand, excess alkali and, on the other, to remove dye-hydrolyzation products from the fiber material.

Accordingly, the object of the present invention was to find a process for the dyeing (including printing) of textile fiber materials which can be carried out using a minimum amount of electrolyte salts or no electrolyte salts at all and, at the same time, using only small amount of an alkaline agent or no such alkaline agent at all.

The present invention now surprisingly makes it possible to obtain even dyeings of high color strength and good fastness properties with anionic dyes, in particular those having fiber-reactive groups, with the use of, if at all, only a small amount of alkaline agents and electrolyte salts if the textile material used is a fiber material which has been pretreated and modified by a compound which is a heterocycloaliphatic compound, containing at least one primary, secondary or tertiary amino group or quaternary ammonium group, it being possible for these amino groups also to form part of the ring, and the hetero portion in the ring being a carbonic ester radical of the formula —O—CO—O— or a carbamic acid radical of the formula —O—CO—NH—.

Examples of such compounds usable according to the invention for the modification of fiber materials are compounds of the formula (1)

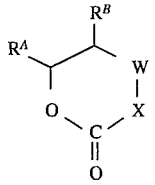

(1)

in which $R^A$ is hydrogen or alkyl of 1 to 3 carbon atoms, which can be substituted by hydroxy or a group of the formula (2) or (3)

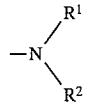

(2)

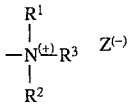

(3)

in which $R^1$ is hydrogen, methyl or ethyl, $R^2$ is hydrogen, methyl or ethyl, and $R^3$ is hydrogen, methyl or ethyl, or $R^1$ and $R^2$ together with the nitrogen atom are a saturated heterocyclic radical formed by an alkylene radical of 5 to 8 carbon atoms or two alkylene radicals of 1 to 4 carbon atoms and an oxygen atom or an amino group of the formula —NH—, such as, for example, an N-piperazino, N-piperidino or N-morpholino radical, and $Z^{\ominus}$ is an anion, such as, for example, a chloride, hydrogen sulfate or sulfate anion;

$R^B$ has one of the meanings given for $R^A$;

W is a direct bond or a group of the formula —$CHR^C$—, in which $R^C$ has one of the meanings given for $R^A$;

X is a group —O— or —NH—.

Preferably, only one of the radicals $R^A$, $R^B$ and $R^C$ is an alkyl group containing a group of the formula (2) or (3).

Examples of such heterocycloaliphatic compounds usable according to the invention are 2-oxo-1,3-oxazolidine, 4-aminomethyl-2-oxo-1,3-oxazolidine, 5-aminomethyl-2-oxo-1,3-oxazolidine, 4-(trimethylammoniummethyl)-2-oxo-1,3-oxazolidine chloride, 5-(trimethylammoniummethyl)-2-oxo-1,3-oxazolidine chloride and 1-(trimethylammoniummethyl)ethylene carbonate chloride.

The compounds usable according to the invention can be prepared by known procedures, such as described in large numbers in the literature (see Houben-Weyl, Methoden der Organischen Chemie (Methods of Organic Chemistry), 4th Ed., volume E4, pages 82–88 and 192 ff.), for example by reaction of an alkanediol containing a latent nitrogen-containing functional group in the side chain with phosgene in aqueous solution at a pH of between 7 and 9 for preparing the heterocycloaliphatic carbonates or, for example, by reaction of aminoalkanols with phosgene in aqueous solution to give the hetero-cycloaliphatic carbamic acid compounds (2-oxo-1,3-oxazolidines).

Accordingly, the present invention relates to a process for the dyeing of fiber materials with water-soluble, anionic dyes, preferably with fiber-reactive dyes, which comprises carrying out the dyeing with the use of a dye solution (dye liquor , printing paste ) which is low in electrolyte or entirely free of electrolyte and/or low in alkali or entirely free of alkali, and with the use of a fiber material pretreated and modified by one of the heterocycloaliphatic compounds described above in more detail.

Fiber materials are understood to mean natural and synthetic fiber materials containing hydroxy and/or carboxamido groups, such as silk, wool and other animal hair, and synthetic polyamide fiber materials and polyurethane fiber materials, for example nylon-4, nylon-6 and nylon-11, and in particular fiber materials containing the basic structure of α,β-glucose, such as cellulose fiber materials, for example cotton, hemp, jute and linen, and regenerated derivatives thereof, such as filament viscose and staple viscose, or blends comprising such fiber materials.

The terms "dyeing", "dyeing methods" and "dyeings" include the printing methods and prints. "Anionic dyes" are understood to mean those containing anionic, i.e. acidic groups, such as sulfo and carboxy groups, or salts thereof, such as alkali metal salts, and accordingly are water-soluble. They are in particular understood to mean those anionic dyes containing a fiber-reactive group, i.e. a group which is usually capable of reacting with the carboxamido or hydroxy groups of the fiber material and combining therewith.

The invention furthermore relates to a process for the modification of a fiber material, which comprises exposing a fiber material to a heterocycloaliphatic compound of the abovementioned type in aqueous, alkaline solution at a temperature of between 60° and 230° C., preferably of between 90° and 190° C.

Furthermore, the invention relates to the use of such heterocycloaliphatic compounds, defined above in more detail, for the modification of fiber materials, in particular with the aim of being able to use them for dyeing with water-soluble, anionic dyes in the absence of or in the presence of only small amounts of electrolyte salts and alkaline agents.

The process according to the invention for the modification of the fiber material can, for example, be carried out such that the fiber material is brought into contact with a heterocycloaliphatic compound usable according to the invention in alkaline aqueous solution. As a rule, the concentration of this compound in the alkaline aqueous solution is between 0.1 and 20% by weight, preferably between 5 and 10% by weight. The alkaline agent, such as, for example, sodium hydroxide, sodium carbonate and potassium carbonate, is dissolved in a concentration of between 0.1 and 20% by weight, preferably of between 5 and 10% by weight. As a rule, the alkaline, aqueous solution containing the heterocycloaliphatic compound has a pH of between 10 and 14.

The fiber material, which is not only modified according to the invention but is also used in the dyeing process according to the invention in the modified form, can be present in any processing state, for example as yarn, loose fiber, tops and pieced goods (woven fabric), and also blended with other fiber materials, such as, in the form of blend fabrics, for example, in the form of cotton/polyester fiber materials.

The heterocycloaliphatic compounds usable according to the invention can be brought into contact with the fiber material in alkaline aqueous solution in various ways in accordance with the dyeing process according to the invention, for example by treating the fiber material in an alkaline, aqueous solution of the ester- and amino-containing compound (analogously to dyeing by the exhaust method) at a temperature of between 15° and 100° C., which already results in modification of the fiber material especially at the higher temperatures. Other possibilities include padding the fiber material with the aqueous, alkaline solution, slop-padding it or spraying the solution on to the fiber material. If impregnation of the fiber material with this alkaline, aqueous solution takes place by introducing the fiber material into this solution or by padding, excess liquor is then squeezed off from the impregnated material so that the pickup of this aqueous alkaline solution is between 50 and 100% by weight, preferably between 70 and 100% by weight, relative to the fiber material. As a rule, impregnation (by padding, slop-padding or treatment in the solution itself) takes place at a temperature of between 10 and 60° C., preferably at a temperature of between 15° and 30° C. If the solution is sprayed on to the fiber material, which usually takes place at a temperature of between 10° and 40° C., a liquor pickup of, preferably, between 10 and 50% by weight is chosen.

If the fiber material is a mercerized cellulose fiber material, the heterocycloaliphatic compound usable according to the invention can advantageously also be applied to the cellulose fiber material to be modified directly after the mercerization process, in which the mercerized material still contains the alkali, for example by squeezing off, if necessary, the material obtainable after the mercerization process and impregnated with the aqueous alkali, to the required fluid content, and impregnating the material, impregnated with alkali, with the aqueous solution of the amino- and ester-containing compound usable according to the invention, it being possible to carry out the impregnation by cross-padding, by spraying and similar process steps customary and known in the art.

After impregnation of the fiber material in one of the abovementioned various ways, with the exception of pretreatment by an exhaust method, the impregnated material is dried; drying is usually carried out simultaneously with fixation of the fiber-modifying compound, the temperature chosen for drying and fixation being between 100° and 230° C., preferably between 120° and 190° C. Usually, drying and simultaneous fixation is carried out by treatment with hot air over a period of 1 to 5 minutes. Fixation of the fiber-modifying heterocycloaliphatic compound on the fiber material can take place by simple drying at elevated temperatures; thus, for drying and fixing the modifying compound on the fiber material, the fiber material can be suspended in drying cabinets and subjected to the required elevated temperatures, such as, for example, 80° to 105° C.

Aftertreatment of the modified fiber material takes place by rinsing with cold and hot water and, if desired, by treatment in an aqueous bath containing a small amount of an acid, such as acetic acid, in order to remove the alkali from the fiber material, followed by drying. If possible, a neutrally reacting fiber material should be used in the dyeing process.

The dyeing according to the invention of fiber materials modified in this manner is carried out analogously to known dyeing procedures and printing processes for the dyeing or printing of fiber materials with water-soluble textile dyes, such as anionic dyes, in particular fiber-reactive dyes, and employing the temperature ranges known to be used for this purpose and the customary amounts of dye, but with the exception according to the invention that the dye baths, padding liquors and printing pastes of the dyeing processes according to the invention, do no longer contain an alkaline compound, such as usually used for fixing fiber-reactive dyes, such as, for example, sodium carbonate, potassium carbonate, sodium hydroxide solution and waterglass, or have it no longer at an essential amount, and that, furthermore, the customary addition of electrolyte salts, which serve in particular for increasing migration of the dye on the fiber, is, if at all, only necessary to a small extent, i.e. to a maximum of 10 g per liter of dye bath or dye liquor. Accordingly, the dyeing process according to the invention is carried out within a pH range of between 4 and 8, preferably of between 4.5 and 7.

Examples of dyeing processes which can be used according to the invention are the various exhaust methods, such as dyeing in a jigger and on the reel back or dyeing from a long or short liquor, dyeing in jet machines, dyeing by the cold pad-batch method or by a pad-steam fixation method. In the exhaust method, dyeing can be carried at the usual liquor ratio of 3:1 to 20:1. The dyeing temperature can be between 30° and 90° C., and is preferably at a temperature below 60°

C.; as can be seen from the above-mentioned use according to the invention of the cold padbatch method, dyeing is advantageously also possible at room temperature (10° to 30° C.).

In the dyeing process according to the invention, the use of the customary, frequently necessary dyeing assistants, such as surfactants (wetting agents), thiourea, thiodiethylene glycol, thickeners, leveling agents, auxiliaries improving the solubility of dyes in the concentrated padding liquors, such as, for example, condensation products of formaldehyde with unsubstituted or alkyl-substituted naphthalenesulfonic acids, and in particular urea, can be omitted entirely or to a substantial degree.

As a rule, the modified fiber material according to the invention can be dyed merely with a pure aqueous dye solution in which additionally only extremely small amounts of electrolyte salts (such as sodium chloride and sodium sulfate) which are present in the dye powders as standardizing agent are dissolved.

The present invention can advantageously also be used for single-bath dyeing processes for the dyeing of cellulose and polyester fiber blends if a disperse dye which is suitable for the dyeing of polyester fiber materials is additionally used in the joint dye bath together with a reactive dye. Since many disperse dyes are sensitive to alkali especially when employing higher temperatures, they cannot be used in the single-bath dyeing of cellulose/polyester blend fiber materials since the application of high temperatures in the alkali-containing bath during dyeing of the polyester fiber with the disperse dye damages the disperse dye. However, the present invention makes it possible to dye in the absence of alkali so that in the aqueous, alkali-free dye liquor first the reactive dye can be fixed on the modified fiber material at a low temperature, such as, for example, at a dyeing temperature of between 30° and 80° C., and the polyester fiber is then dyed with a disperse dye in the usual manner at temperatures above 100° C., such as, for example, of between 110° and 140° C.

Any water-soluble, preferably anionic, dyes which preferably have one or more sulfo and/or carboxy groups and which also may contain fiber-reactive groups are suitable for the dyeing procedure according to the invention. Apart from the group of fiber-reactive dyes, they can belong to the group of azo developing dyes, of direct dyes, of vat dyes and of acid dyes, which can, for example, be azo dyes, copper complex, cobalt complex and chromium complex azo dyes, copper phthalocyanine and nickel phthalocyanine dyes, anthraquinone, copper formazan and triphendioxazine dyes. Such dyes have been described in the literature in large numbers and are known to those skilled in the art in all respects.

Of the abovementioned dyes usable for the dyeing process according to the invention, the fiber-reactive dyes are preferably used. Fiber-reactive dyes are those organic dyes containing 1, 2, 3 or 4 fiber-reactive radicals from the aliphatic, aromatic or heterocyclic series. Such dyes have been described in the literature in large numbers. The dyes can belong to a wide range of classes of dyes, such as, for example, to the class of monoazo, disazo, polyazo, metal complex azo dyes, such as 1:1 copper complex monoazo and disazo dyes, 1:2 chromium complex monoazo and disazo dyes, and 1:2 cobalt complex monoazo and-disazo dyes, furthermore to the series of anthraquinone dyes, copper phthalocyanine and cobalt phthalocyanine dyes, copper formazan dyes, azomethine, nitroaryl, dioxazine, triphendioxazine, phenazine and stilbene dyes. Fiber-reactive dyes are understood to mean those containing a "fiber-reactive" group, i.e. a group which is capable of reacting with the hydroxy groups of cellulose, the amino, carboxy , hydroxy or mercapto groups of wool and silk or with the amino and carboxy groups, if present, of synthetic polyamides with the formation of covalent chemical bonds. The fiber-reactive radical can be bound to the dye radical directly or via a bridging member; preferably, it is bound to the dye radical directly or via an amino group which may be monoalkylated, such as, for example, a group of the formula —NH—, —N($CH_3$)—, —N($C_2H_5$)— or —N($C_3H_7$)—, or via an aliphatic radical, such as a methylene, ethylene or propylene radical or an alkylene radical of 2 to 8 carbon atoms, which may be interrupted by one or two oxy and/or amino groups, or via a bridging member containing an amino group, such as, for example a phenylamino group. Examples of fiber-reactive radicals are: vinylsulfonyl, β-chloroethylsulfonyl, β-sulfatoethylsulfonyl, β-acetoxy-ethylsulfonyl, β-phosphatoethylsulfonyl, β-thiosulfatoethylsulfonyl, N-methyl-N-(β-sulfatoethylsulfonyl)amino, acryloyl, —CO—CCl=$CH_2$, —CO—CH=CH—Cl, —CO—CCl—CHCl, —CO—CCl=CH—$CH_3$, —CO—CBr=$CH_2$, —CO—CH=CH—Br, —CO—CBr=CH—$CH_3$, —CO—CCl=CH—COOH, —CO—CH=CCl—COOH, —CO—CBr=CH—COOH, —CO—CH=CBr—COOH, —CO—CCl=CCl—COOH, —CO—CBr=CBr—COOH, β-chloro- or β-bromopropionyl, 3-phenylsulfonylpropionyl, 3-methylsulfonylpropionyl, 3-chloro-3-phenylsulfonylpropionyl, 2,3-dichloropropionyl, 2,3-dibromopropionyl, 2-fluoro-2-chloro-3,3-difluorocyclobutane-2-carbonyl, 2,2,3,3-tetrafluorocyclobutane-1-carbonylor-1-sulfonyl, β-(2,2,3,3-tetrafluorocyclobutyl)acryloyl, α- or β-methylsulfonylacryloyl, propionyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl, 4-fluoro-3-nitrobenzoyl, 4-fluoro-3-nitrophenylsulfonyl, 4-fluoro-3-methylsulfonylbenzoyl, 4-fluoro-3-cyanobenzoyl, 2-fluoro-5-methylsulfonylbenzoyl, 2,4-dichloro-6-triazinyl, 2,4-dichloro-6-pyrimidinyl, 2,4,5-trichloro-6-pyrimidinyl, 2,4-dichloro-5-nitro- or -5-methyl- or -5-carboxymethyl- or -5-carboxy- or -5-cyano- or -5-vinyl or -5-sulfo- or -5-mono-, -di- or -trichloromethyl- or -5-methylsulfonyl-6-pyrimidinyl, 2,5-dichloro-4-methylsulfonyl-6-pyrimidinyl, 2-fluoro-4-pyrimidinyl, 2-fluoro-5-chloro-6-methyl-4-pyrimidinyl, 2-fluoro-5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 6-trifluoromethyl-2-fluoro-4-pyrimidinyl, 2-fluoro-5-nitro-4-pyrimidinyl, 2-fluoro-5-trifluoromethyl-4-pyrimidinyl, 2-fluoro-5-phenyl- or -5-methylsulfonyl-4-pyrimidinyl, 2-fluoro-5-carboxamido-4-pyrimidinyl, 2-fluoro-5-carbomethoxy-4-pyrimidinyl, 2-fluoro-5-bromo-6-trifluoromethyl-4-pyrimidinyl, 2-fluoro-6-carboxamido-4-pyrimidinyl, 2-fluoro-6-carbomethoxy-4-pyrimidinyl, 2-fluoro-6-phenyl-4-pyrimidinyl, 2-fluoro-6-cyano-4-pyrimidinyl, 2,6-difluoro-5-methylsulfonyl-4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl, 2,4-bis (methylsulfonyl)-4-pyrimidinyl, 2,5-bis(methylsulfonyl)-5-chloro-4-pyrimidinyl, 2-methylsylfonyl-4-pyrimidinyl, 2-phenylsulfonyl-4-pyrimidinyl, 2-methylsulfonyl-5-chloro-6-methyl-4-pyrimidinyl, 2-methylsulfonyl-5-bromo-6-methyl-4-pyrimidinyl, 2-methylsulfonyl-5-chloro-6-ethyl-4-pyrimidinyl, 2-methylsulfonyl-5-chloromethyl-4-pyrimidinyl, 2-methylsulfonyl-5-nitro-6-methyl-4-pyrimidinyl, 2,5,6-tris(methylsulfonyl)-4-pyrimidinyl, 2-methylsulfonyl-5,6-dimethyl-4-pyrimidinyl, 2-ethylsulfonyl-5-chloro-6-methyl-4-pyrimidinyl, 2-methylsulfonyl-6-chloro-4-pyrimidinyl, 2,6-bis(methylsulfonyl)-5-chloro-4-pyrimidinyl, 2-methylsulfonyl-6-carboxy-4-pyrimidinyl, 2-methylsulfonyl-5-sulfo-4-pyrimidinyl, 2-methylsulfonyl-6-carbomethoxy-4-pyrimidinyl, 2-methylsulfonyl-5-carboxy-4-pyrimidinyl, 2-methylsulfonyl-5-cyano-6-methoxy-4-pyrimidinyl, 2-methylsulfonyl-5-chloro-4-pyrimidinyl, 2-sulfoethylsulfonyl-6-methyl-4-pyrimidinyl, 2-methylsulfonyl-5-bromo-4-pyrimidinyl, 2-phenylsulfonyl-5-chloro-4-pyrimidinyl, 2-carboxymethylsulfonyl-5-chloro-6-methyl-4-pyrimidinyl, 2,4-dichloropyrimidine-6-carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine-5-carbonyl, 2,4,6-trichloropyrimidine-5-carbonyl, 2,4-dichloropyrimidine-5-sulfonyl, 2,4-dichloro-6-methylpyrimidine-5-carbonyl or -5-sulfonyl, 2-methylsulfonyl-6-chloro-4-pyrimidine and -5-carbonyl, 2,6-bis(methylsulfonyl)pyrimidine -4- or -5-carbonyl, 2-ethylsulfonyl-6-chloropyrimidine-5-carbonyl, 2,4-bis(methylsulfonyl)-pyrimidine-5-sulfonyl, 2-methylsulfonyl-4-chloro-6-methylpyrimidine-5-sulfonyl or 5-carbonyl, 2-chloroquinoxaline-3-carbonyl, 2- or 3-monochloroquinoxaline-6-carbonyl, 2- or 3-monochloroquinoxaline-6-sulfonyl, 2,3-dichloroquinoxalin-5- or 6-carbonyl, 2,3-dichloroquinoxaline-5- or -6-sulfonyl, 1,4-dichlorophthalazine-6-sulfonyl or -6-carbonyl, 2,4-dichloroquinazoline-7- or 6-sulfonyl, or -carbonyl, 2,4,6-trichloroquinazoline-7- or -8-sulfonyl, 2- or 3- or 4-(4',5'-dichloro-6'-pyridazone-1'-yl)-phenylsulfonyl or -carbonyl, β-(4',5'-dichloro-6'-pyridazinone-1'-yl)propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or 2-alkylsulfonylbenzothiazole-5- or -6-carbonyl, or -5- or -6-sulfonyl, such as 2-methylsulfonyl- or 2-ethylsulfonylbenzothiazole-5- or -6-sulfonyl or -carbonyl, 2-phenylsulfonylbenzothiazole-5- or -6-sulfonyl or -carbonyl and the corresponding 2-sulfonyl benzothiazole-5- or -6-carbonyl or -sulfonyl derivatives containing sulfo groups in the fused-on benzene ring, 2-chlorobenzoxazole-5- or -6-carbonyl or -sulfonyl, 2-chlorobenzimidazole-5- or -6-carbonyl or -sulfonyl, 2-chloro-1-methylbenzimidazole-5- or -6-carbonyl or -sulfonyl, 2-chloro-4-methyl-1,3-thiazole-5-carbonyl or -4- or -5-sulfonyl; triazine rings containing ammonium groups, such as 2-trimethylammonio-4-phenylamino- and -4-(o,m- or p-sulfophenylamino)-6-triazinyl, 2-(1,1-dimethylhydrazino)-4-phenylamino- and -4-(o-, m- or p-sulfophenylamino)-6-triazinyl, 2-(2-isopropylidene-1,1-dimethylhydrazino)-4-phenylamino-and -4-(o-, m- or p-sulfophenylamino)-6-triazinyl, 2-N-aminopyrrolidino-, 2-N-aminopiperidino-4-phenylamino- or -4-(o-, m- or p-sulfophenylamino)-6-triazinyl, 4-phenylamino- or 4-(sulfophenylamino)-6-triazinyl, which contain 1,4-bisazabicyclo[2.2.21]octane or 1,2-bisazabicyclo[0.3.3]octane bound in the 2-position via a quaternary nitrogen bond, 2-pyridino-4-phenylamino- or -4-(o-, m- or p-sulfophenylamino)-6-triazinyl and the corresponding 2-onium-6-triazinyl radicals substituted in the 4 position by alkylamino, such as methylamino, ethylamino or β-hydroxyethylamino, or alkoxy, such as methoxy or ethoxy, or aryloxy, such as phenoxy or sulfophenoxy.

Particularly interesting fiber-reactive radicals are fluoro- and chloro-1,3,5-triazine radicals of the formula (4)

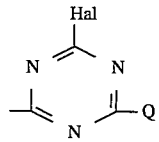

(4)

in which Hal is chlorine or fluorine and Q is an amino, alkylamino, N,N-dialkylamino, cycloalkylamino, N,N-dicycloalkylamino, aralkylamino, arylamino, N-alkyl-N-cyclohexylamino, N-alkyl-N-arylamino group or an amino group containing a heterocyclic radical, which may contain a further fused-on carbocyclic ring, or amino groups in which the amino nitrogen atom is a member of an N-heterocyclic ring which, if desired, contains further hetero atoms, and hydrazino and semicarbazido groups, in which the alkyl radicals mentioned can be straight-chain or branched and can have low molecular weight or high molecular weight, preferably those having 1 to 6 carbon atoms. Suitable cycloalkyl, aralkyl and aryl radicals are in particular cyclohexyl, benzyl, phenethyl, phenyl and naphthyl radicals; heterocyclic radicals are in particular furan, thiophene, pyrazole, pyridine, pyrimidine, quinoline, benzimidazole, benzothiazole and benzoxazole radicals. Suitable amino groups in which the amino nitrogen atom is a member of an N-heterocyclic ring are preferably radicals of 6-membered N-heterocyclic compounds which can contain, as further hetero atoms, nitrogen, oxygen or sulfur. The abovementioned alkyl, cycloalkyl, aralkyl and aryl radicals, the heterocyclic radicals and the N-heterocyclic rings can be additionally substituted, for example by halogen, such as fluorine, chlorine and bromine, nitro, cyano, trifluoromethyl, sulfamoyl, carbamoyl, $C_1$–$C_4$–alkyl, $C_1$–$C_4$–alkoxy, acylamino groups, such as acetylamino or benzoylamino, ureido, hydroxyl, carboxy , sulfomethyl or sulfo. Examples of such amino groups include: $-NH_2$, methylamino, ethylamino, propylamino, isopropylamino, butylamino, hexylamino, β-methoxyethylamino, γ-methoxypropylamino, β-ethoxyethylamino, N,N-dimethylamino, N,N-diethylamino, β-chloroethylamino, β-cyanoethylamino, γ-cyanopropylamino, β-carboxyethylamino, sulfomethylamino, γ-sulfoethylamino, β-hydroxyethylamino, N,N-di-β-hydroxyethylamino, γ-hydroxypropylamino, benzylamino, phenethylamino, cyclohexylamino, phenylamino, toluidino, xylidino, chloroanilino, anisidino, phenetidino, N-methyl-N-phenylamino, N-ethyl-N-phenylamino, N-β-hydroxyethyl-N-phenylamino, 2-, 3- or 4-sulfoanilino, 2,5-disulfoanilino, 4-sulfomethylanilino, N-sulfomethylanilino, 2-, 3- or 4-carboxyphenylamino, 2-carboxy-5-sulfophenylamino, 2-carboxy-4-sulfophenylamino, 4-sulfo-1-naphthylamino, 3,6-disulfo-1-naphthylamino, 3,6,8-trisulfo-1-naphthylamino, 4,6,8-trisulfo-1-naphthylamino, 1-sulfo-2-naphthylamino, 1,5-disulfo-2-naphthylamino, 6-sulfo-2-naphthylamino, morpholino, piperidino, piperazino, hydrazino and semicarbazido.

Furthermore, Q can be an amino radical of the formula $—NR^{10}R^{11}$, in which $R^{10}$ is hydrogen or alkyl of 1 to 4 carbon atoms, such as methyl or ethyl, and $R^{11}$ is phenyl which is substituted by a fiber-reactive radical from the vinylsulfone series directly or via a methylamino, ethylamino, methylene, ethylene or propylene group and which can be additionally substituted by 1 or 2 substituents from the group comprising methoxy, ethoxy, methyl, ethyl, chlorine, carboxy and sulfo, or $R^{11}$ is alkyl of 2 to 4 carbon atoms, such as ethyl or n-propyl, which is substituted by fiber-reactive group from the vinylsulfone series, or is alkylenephenyl having an alkylene radical of 1 to 4 carbon atoms, the phenyl of which is substituted by a fiber-reactive radical from the vinylsulfone series, or in which $R^{10}$ and $R^{11}$ are both alkyl or 2 to 4 carbon atoms, such as ethyl and n-propyl, which are substituted by a fiber-reactive group from the vinyl sulfone series, or in which $R^{10}$ and $R^{11}$ are both alkylene of 3 to 8 carbon atoms which are interrupted by 1 or 2 oxy and/or amino groups and are terminated by a fiber-reactive group from the vinylsulfone series. Fiber-reactive groups from the vinylsulfone series are those of the formula $—SO_2—Y$, in which Y is vinyl or ethyl which is substituted in the β position by a substituent which can be eliminated by alkali, such as, for example, by chlorine, sulfato, phosphato, thiosulfato, acetyloxy, sulfobenzoyloxy and dimethylamino.

The dyeings of the modified cellulose fiber materials obtainable according to the invention do not require any further aftertreatment, in particular no expensive after-treatment process including a wash, after their removal from the dye bath or after fixation of the dye on the substrate is complete. As a rule, a customary single or repeated rinsing of the dyed substrate with warm or hot and, if desired, cold water which, if desired, may contain a nonionic wetting agent is usually sufficient. A boiling treatment of the dyed substrate with a wash solution for improving the fastness properties is not required.

The Examples which follow serve to illustrate the invention. Parts and percentages given therein are by weight unless stated otherwise. Parts by weight relate to parts by volume as the kilogram relates to the liter.

EXAMPLE 1 a) A fabric made of mercerised and bleached cotton is impregnated with an aqueous solution of 20 to 25° C. of 50 parts of sodium hydroxide and 50 parts of 2-oxo-1,3-oxazolidine in 1000 parts of water at a liquor pickup of 75%. The material is then treated with hot air at 180° C. for 45 seconds, resulting not only in drying but also in fixation of the oxazolidinone compound on the fabric. The material is then treated in cold and hot water at 60° C. and, if desired, in an aqueous bath containing acetic acid until any residual alkali has been removed from the fabric.

b) The modified cotton fabric is dyed analogously to a customary exhaust dyeing method: 100 parts of the modified fabric are introduced into 2000 parts by volume of an aqueous dye solution containing 2 parts of a 50% electrolyte-containing (predominantly sodium chloride containing) dye powder of the known dye of the formula

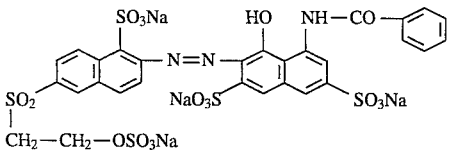

(i.e. 1 part of this dye and 1 part of the electrolyte) in dissolved form; the dye bath is heated to 60° C. over a period of 30 minutes, and the dyeing process is continued at this temperature for 60 minutes. The dyed fabric is then rinsed with cold and hot water, it being possible for the hot water to contain a commercially available wetting agent, and, if desired, again rinsed with cold water and dried.

This gives a uniform red dyeing of high color strength which exhibits good general fastness properties, in particular good rub and light fastness properties.

EXAMPLE 2

A cotton fabric modified according to the invention by the procedure of Example 1a) is dyed by customary cold pad-batch dyeing method. To this end, an aqueous dye solution containing, in 1000 parts by volume, 20 parts of the known dye of the formula

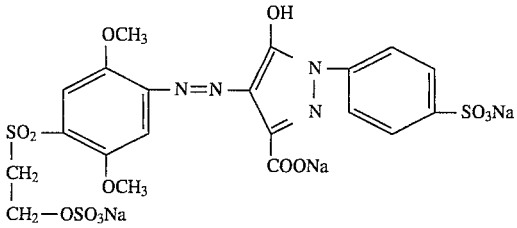

100 parts of urea and 3 parts of a commercially available nonionic wetting agent in dissolved form is applied to the fabric at 25° C. by means of a pad-mangle at a liquor pickup of 80%, relative to the weight of the fabric. The fabric padded with the dye solution is wound on to a roller, packed into a plastic film and left at 40° to 50° C. for 4 hours and then rinsed with cold and hot water which, if desired, may contain a commercially available wetting agent and, if desired, rinsed again with cold water and dried.

This gives a uniformly dyed yellow dyeing of high color strength which exhibits good general fastness properties, in particular good rub and light fastness properties.

EXAMPLE 3 a) A mercerised and bleached cotton fabric is impregnated with an aqueous solution of 37.5 parts of sodium hydroxide and 75 parts of 2-oxo-1,3-oxazolidine in 1000 parts of water at a temperature of between 25° and 30° C. and a liquor pickup of 85% and then treated with hot air at 150° C. for about 2.5 minutes in order to fix the oxazolidinone compound on the fiber material which simultaneously results in drying of the impregnated fabric. Excess alkali is then removed from the modified material by treatment with cold and hot water at 60° C.

b) The modified, dried fabric is dyed by a customary exhaust method. To this end, 10 parts of this material are introduced into 200 parts by volume of an aqueous dye solution containing 0.2 part of dye of the formula

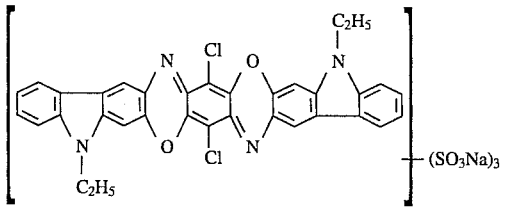

(known from Color Index under the C.I. No. 51 320) in dissolved form. Dyeing at 80° C. is carried out for 60 minutes. The dyed fabric is then rinsed with cold and hot water which, if desired, may contain a commercially available nonionic surfactant, then, if desired, washed again with cold water and dried.

This gives a deep blue dyeing having good fastness properties customary for this dye.

EXAMPLE 4 a) 10 parts of a polyester/cotton blend fabric are padded with an aqueous solution containing 75 parts of 2-oxo-1,3-oxazolidine and 37.5 parts of sodium hydroxide dissolved in 1000 parts of water at a liquor pickup of 80%, relative to the weight of the fabric. The impregnated fabric is then subjected to dry heat setting at 180° C. for 30 seconds, then thoroughly washed with cold and hot water at 60° C., to which a nonionic wetting agent can be added, and again rinsed with cold water.

b) The modified material is placed in a HT-dyeing machine and treated with an aqueous dye liquor containing, relative to the weight of the dry material, 0.1 part of the fiber-reactive copper formazan dye disclosed in Example 1 of European Patent No. 0,028,788 and 0.1 part of the disperse dye of the formula

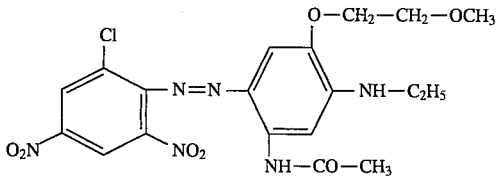

disclosed in Example 1 of DE-B-2,833,854 at a liquor ratio of 20:1 first at 60° C. for 30 minutes and then at 130° C. for another 30 minutes. The dyed fabric is then finished in the usual manner, giving a deep blue dyeing on both fiber components having good fastness properties.

EXAMPLE 5

The procedure of Example 4 for the dyeing of a polyester/cotton blend fabric is repeated, except that the disperse dye of the formula

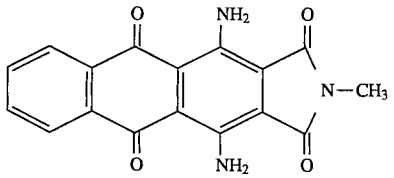

disclosed in Japanese Patent Application Publication Sho-54/69139 and the fiber-reactive copper phthalocyanine dye of the formula

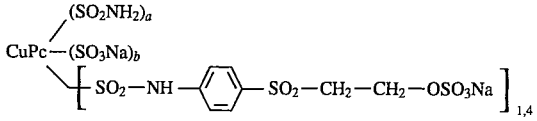

in which (a+b) is equal to 2.6, disclosed in Example 3 of DE-B-2,835,035 are used, giving, after customary finishing, a very vividly bright blue-dyed blend fabric having excellent fastness properties.

EXAMPLES 6 TO 17

Further dyeings can be produced by starting with a cellulose fiber material modified according to the invention, such as, for example, a cellulose fiber material modified in accordance with the above exemplary embodiments and subjecting it to a dyeing process by one of the customary dyeing methods, such as printing methods, exhaust methods or padding methods, for example analogously to one of the dyeing procedures described in the above exemplary embodiments, using one of the known dyes listed in the Table Examples below in accordance with the invention, i.e. without using alkali and only using, if at all, a very small amount of electrolyte, it also being possible for the material used to be a modified cellulose fiber material in a blend with a polyester fiber material. Here, with respect to the cellulose fiber material, clear dyeings and prints of high color strength having the shade listed in the particular Table Example and the good fastness properties listed for the particular dye are obtained.

| Ex. | Dye used (as the alkali metal salt) | Shade |
|---|---|---|
| 6 | 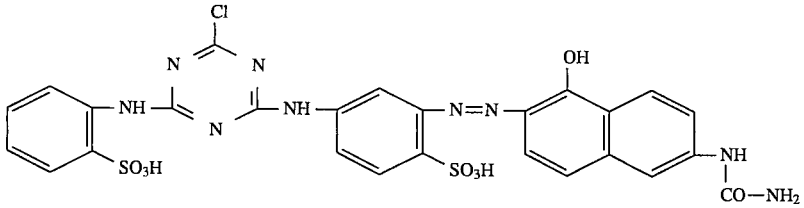 | orange |
| 7 | 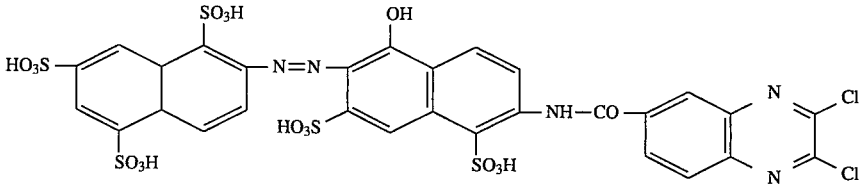 | orange |
| 8 | 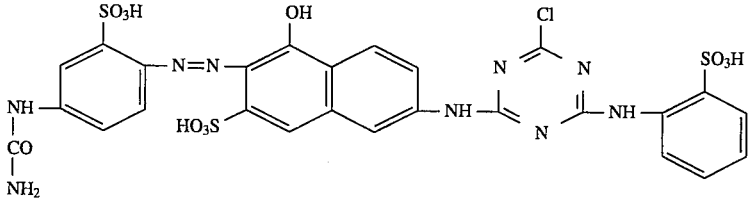 | scarlet |

-continued
| Ex. | Dye used (as the alkali metal salt) | Shade |
|---|---|---|
| 9 | 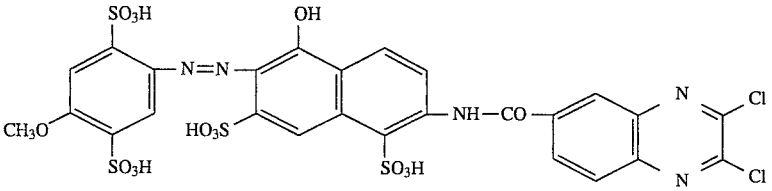 | scarlet |
| 10 | 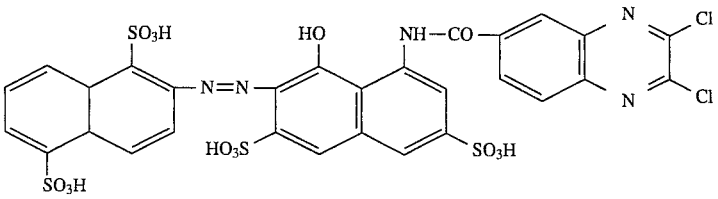 | red |
| 11 | 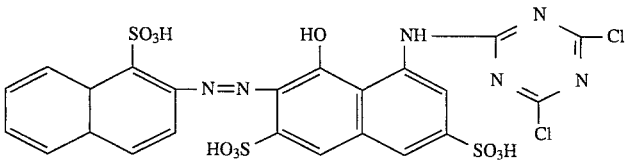 | red |
| 12 | 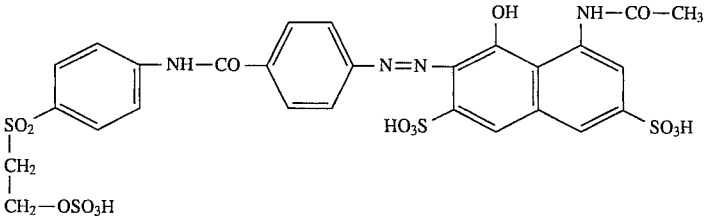 | red |
| 13 | 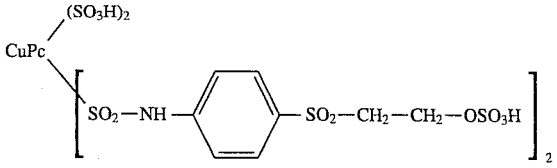 <br>CuPc = Copper phthalocyanine | turquoise |
| 14 | 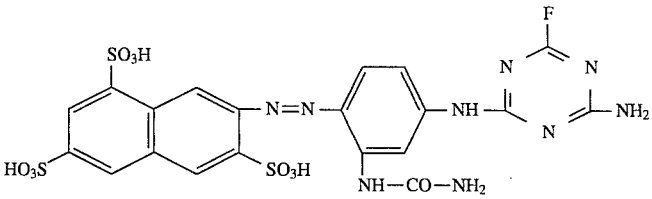 | yellow |
| 15 | 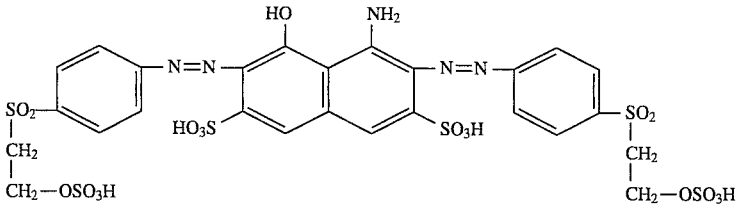 | navy blue |

-continued

| Ex. | Dye used (as the alkali metal salt) | Shade |
|---|---|---|
| 16 | 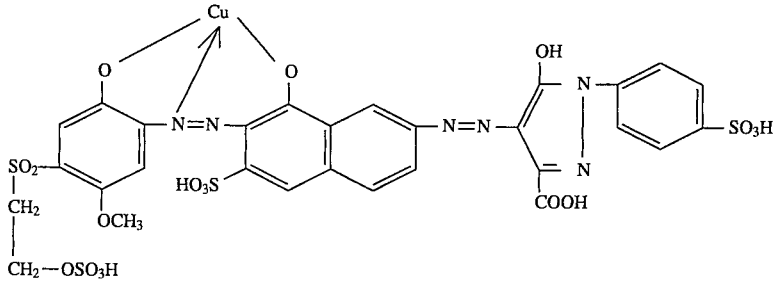 | anthracite |
| 17 | 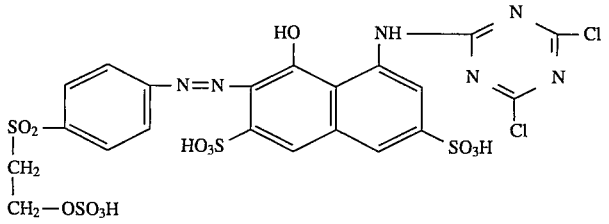 | red |

What is claimed is:

1. A process for dyeing of a fiber material containing hydroxy or carboxamido groups, or hydroxy and carboxamido groups, with a water-soluble fiber-reactive dye, which comprises contacting said fiber material with a dye solution, dye liquor or printing paste which contains electrolytes in an amount of from 0 to 10 g/l and has a pH range of between 4 and 8 wherein said fiber material has been pretreated and modified at a pH of between 10 and 14 with a compound of the formula (1)

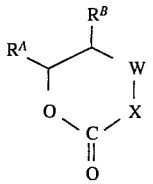

(1)

in which $R^A$ is hydrogen or alkyl of 1 to 3 carbon atoms, unsubstituted or substituted by hydroxy or a group of the formula (2) or (3)

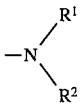

(2)

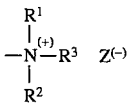

(3)

in which $R^1$ is hydrogen, methyl or ethyl, $R^2$ is hydrogen, methyl or ethyl, and $R^3$ is hydrogen, methyl or ethyl, or $R^1$ and $R^2$ together with the nitrogen atom are a saturated heterocyclic radical formed by an alkylone of 5 to 8 carbon atoms or by two alkylenes of 1 to 4 carbon atoms and an oxygen or an amino of the formula —NH—, and $Z^{(-)}$ is an anion;

$R^B$ has one of the meanings given for $R^A$;

given for $R^A$;

X is a group —O— or —NH—;

containing at least one primary, secondary or tertiary amine group or quaternary ammonium group as a substituent to the cyclus or forming a part of said ring, or being both.

2. The process as claimed in claim 1, wherein the compound of the formula (1) is fixed onto said fiber material at a temperature of between 120° and 190° C.

3. A process for the modification of a fiber material containing hydroxy or carboxamido groups, or hydroxy and carboxamido groups which comprises exposing the fiber material to a composition consisting essentially of a compound of the formula (1)

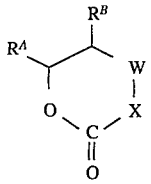

(I)

in which $R^A$ is hydrogen or alkyl of 1 to 3 carbon atoms, unsubstituted or substituted by hydroxy or a group of the formula (2) or (3)

in which $R^1$ is hydrogen, methyl or ethyl, $R^2$ is hydrogen, methyl or ethyl, and $R^3$ is hydrogen, methyl or ethyl, or $R^1$ and $R^2$ together with the nitrogen atom are a saturated heterocyclic radical formed by an alkylene of 5 to 8 carbon atoms or by two alkylenes of 1 to 4 carbon atoms and an oxygen or an amino of the formula —NH—, and $Z^{(-)}$ is an anion;

$R^B$ has one of the meanings given for $R^A$;

W is a direct bond or a group of the formula —$CHR^C$— in which $R^C$ has one of the meanings given for $R^A$;

X is a group —O— or —NH—;

containing at least one primary, secondary or tertiary amine group or quaternary ammonium group as a substituent to the cyclus or forming a part of said ring, or being both, in an aqueous, alkaline solution at a pH of between 10 and 14 and then fixing the compound of the formula (1) onto said fiber material at a temperature of between 100° and 230° C.

4. A process for the single-bath dyeing of a cellulose/polyester blend fiber material, which comprises dyeing a fiber material which has been modified according to claim 3, in an aqueous, alkali-free dye liquor containing at least one fiber-reactive dye and at least one disperse dye.

5. The process as claimed in claim 3, wherein compound of the formula (1) is fixed onto said fiber material at a temperature in the range of 120° to 190° C.

* * * * *

UNITED STATES PATENT AND TRADEMARK OFFICE

CERTIFICATE OF CORRECTION

PATENT NO. : 5,601,621

DATED : FEBRUARY 11, 1997

INVENTOR(S) : Andreas Schrell et al.

It is certified that error appears in the above-indentified patent and that said Letters Patent is hereby corrected as shown below:

Claim 1, column 15, line 62, "alkylone" should read --alkylene--;

Claim 1, column 16, line 25, please insert the missing passage, --W is a direct bond or a group of the formula
$-CHR^C-$ in which $R^C$ has one of the meanings--;

UNITED STATES PATENT AND TRADEMARK OFFICE

CERTIFICATE OF CORRECTION

PATENT NO. : 5,601,621

DATED : FEBRUARY 11, 1997

INVENTOR(S) : Andreas Schrell et al.

It is certified that error appears in the above-indentified patent and that said Letters Patent is hereby corrected as shown below:

Claim 3, column 16, after line 50, should read

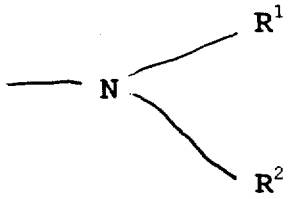

(2)

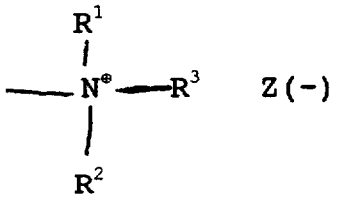

(3)

Signed and Sealed this

Sixteenth Day of September, 1997

*Attest:*

BRUCE LEHMAN

*Attesting Officer*

*Commissioner of Patents and Trademarks*